United States Patent [19]

Parein

[11] Patent Number: 4,705,164

[45] Date of Patent: Nov. 10, 1987

[54] PACKAGE FOR MATCHES

[76] Inventor: Eric W. M. V. Parein, Faiderstraat 79, Elsene, Belgium, B-1050

[21] Appl. No.: 716,700

[22] Filed: Mar. 27, 1985

Related U.S. Application Data

[62] Division of Ser. No. 456,057, Jan. 5, 1983, Pat. No. 4,525,981.

[30] Foreign Application Priority Data

May 15, 1981 [BE] Belgium ..... 0/204 805
May 14, 1982 [WO] PCT Int'l Appl. ... PCT/BE82/00010

[51] Int. Cl.[4] ..... A24F 27/20; A24F 27/26

[52] U.S. Cl. ..... 206/98; 206/100; 206/118; 206/450

[58] Field of Search ..... 206/98, 99, 100, 118, 206/450; 53/395

[56] References Cited

U.S. PATENT DOCUMENTS

| | | | |
|---|---|---|---|
| 528,186 | 10/1894 | Strakosch | 206/100 |
| 872,243 | 11/1907 | Luna | 206/98 |
| 1,861,356 | 5/1932 | Payne | 206/100 |
| 1,896,573 | 2/1933 | Buxton | 206/450 |
| 1,942,300 | 1/1934 | Lerch | 206/100 |
| 2,097,839 | 11/1937 | Leukhardt | 206/99 |
| 2,344,059 | 3/1944 | Pvllen | 206/98 |
| 2,405,865 | 8/1946 | Watkins | 206/98 |
| 2,771,183 | 11/1956 | Carter | 206/98 |
| 3,891,083 | 6/1975 | Roth | 206/98 |
| 4,016,973 | 4/1977 | Blake | 206/118 |
| 4,221,289 | 9/1980 | Lodrick | 206/98 |
| 4,471,874 | 9/1984 | Morane | 206/581 |

FOREIGN PATENT DOCUMENTS

| | | | |
|---|---|---|---|
| 8300799 | 11/1983 | Netherlands | 206/98 |
| 390056 | 3/1933 | United Kingdom | 206/100 |

*Primary Examiner*—William Price
*Assistant Examiner*—Brenda J. Ehrhardt
*Attorney, Agent, or Firm*—John P. Snyder

[57] ABSTRACT

A match package includes a synthetic resin core in combination with cover members sandwiching the core to define a space of uniform height. The core includes partition walls dividing the space into oblong compartments. The walls are joined at one end to block those ends of the compartments and at the other end are joined by floors which reduce the height of the space in each compartment. The head of a match is positioned at the blocked end of the compartment and its free end projects from the other, open end. Striking material on the cover portions which oppose the floors frictionally engage a match head to ignite same in response to axial withdrawal of a match from its compartment.

11 Claims, 5 Drawing Figures

PACKAGE FOR MATCHES

CROSS REFERENCE TO RELATED APPLICATION:

This application is a division of copending parent application Ser. No. 456,057, filed Jan. 5, 1983 as the National Stage of PCT/BE82/OOO1O, filed May 14, 1982 (now WO 82/03973, published Nov. 25, 1982) and claiming priority under 35 USC 119 to Belgian application No. 0/204 805, filed May 15, 1981, and which parent application is now U.S. Pat. No. 4,525,981 issued July 2, 1985.

A relatively flat prismatic core cooperates with closure means in the form of a top member and a bottom member to define a match-receiving space of generally uniform height and the core includes a series of partition walls which divide the match-receiving space into a series of oblong compartments for the matches. The compartments are situated in side-by-side relation, separated by the partition walls. First means joins the partition walls for a portion of the length of each compartment to reduce the heights thereof while leaving each compartment open at one end. Second means joins the partition walls at the opposite ends of the compartments and closes off such opposite ends, thereby completing an oblong compartment for each match. The head end of each match is initially located adjacent the closed end of its compartment while its free end projects from the open end and striking means cooperates with the first means to frictionally engage the match head and automatically ignite it in response to axial withdrawal of the match from its compartment.

Conveniently, a core is used wherein the compartments for successive matches are nearly completely open at one main face of the core and at the opposite face thereof in an alternating way, the closure means being formed then by a top sheet and a bottom sheet which are adhered to the noncompletely open top and bottom sides of the compartments.

The core comprising the partition walls, the first means and the second means are integrally formed of plastic material to form a relatively rigid unit which provides the major structural integrity of the match package.

This invention also relates to a method of separately conditioning matches in a package subdivided into oblong compartments in each of which is arranged a match, said compartments being closed at one end and open at the opposite end in such a way that the head of the match is located at the closed end and the free end of the match projects beyond the open end of its compartment to allow for the removal of the match from its compartment while, in the process, the match is automatically ignited.

More precisely, an object is to provide a method permitting a continuous commercial manufacture of match-filled packages in a very efficient and also simple way.

According to a special embodiment of the invention, a recess providing a sufficiently large space for the head of the match to be located therein is provided in the longitudinal side of the housings facing the almost completely open longitudinal side and at least at the location of the head of the matches.

In a preferred embodiment of the invention, the matches are moved into the housings of the core in longitudinal direction.

The invention also relates to an apparatus for the separate conditioning of matches and more precisely for effecting the above mentioned method.

Further particulars and further advantages of the invention will be clear from reading the following description of some specific embodiments of the invention; such description is only given by way of example and cannot restrict the invention. The reference numbers used hereinafter relate to the attached Figures of the drawing.

DETAILED DESCRIPTION OF THE DRAWING FIGURES

In all these different Figures, the same reference numbers relate to the same elements.

DETAILED DESCRIPTION OF THE INVENTION

Figure 1:
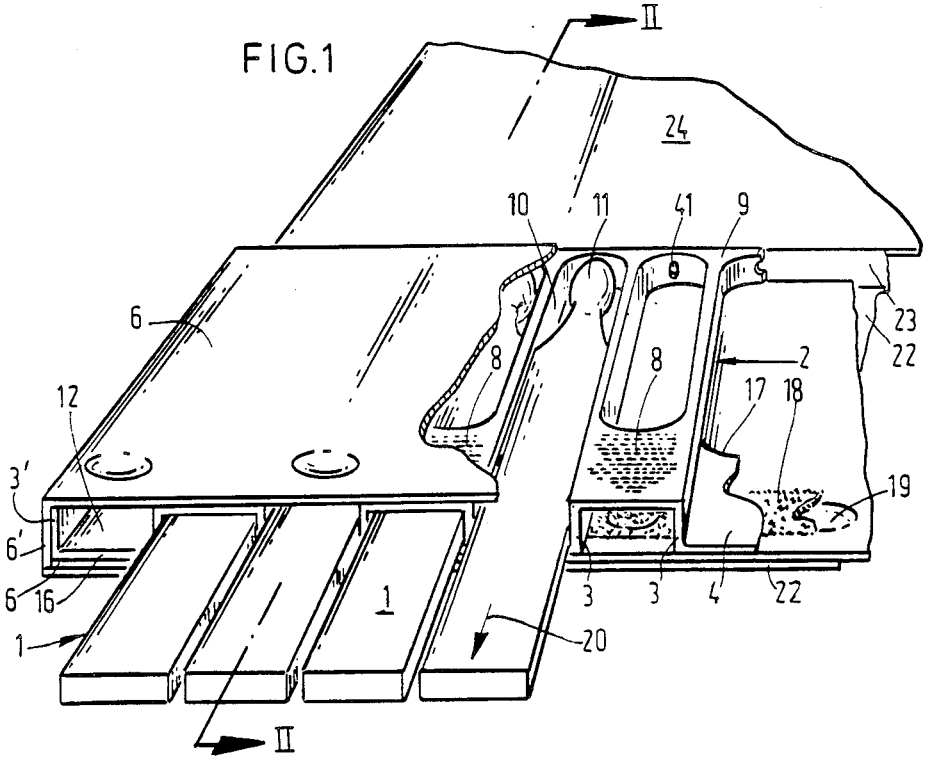
FIG. 1 is a perspective view, and partial section, of a match-filled package according to the present invention.
Figure 2:
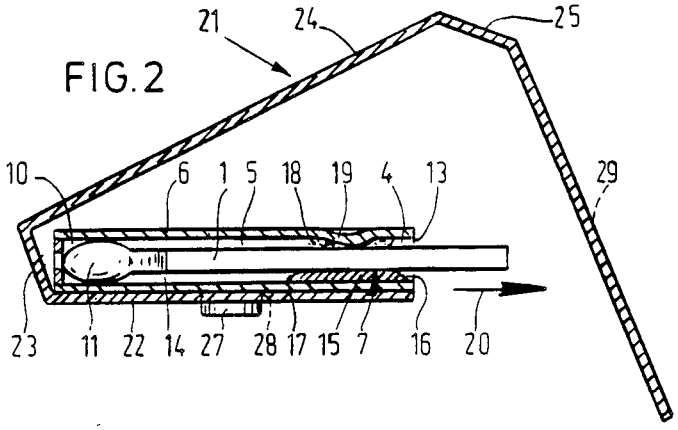
FIG. 2 is a section along the line II—II of FIG. 1.

The invented method of conditioning matches, as illustrated by the figures, is mainly composed of two important steps.

In the first step, matches 1 are inserted into a relatively flat prismatic core 2, preferably made from synthetic material and having a thickness which is only a little bit higher than the corresponding thickness of the match heads.

The core 2 comprises a series of successive oblong housings 4 separated from each other by partition walls 3 in their longitudinal direction and being completely open at one of their outer longitudinal sides such that there is no risk whatsoever for the matches to be clamped or broken, at the moment that they are inserted into the housings 4 of the core 2.

Thereupon, in a second step, said open longitudinal sides 5 are covered by closure means 6 in such a way that the matches 1 are removably confined in their corresponding housings 4.

In the embodiment as shown in the figures, use is made of a core 2 wherein the successive housings 4 for the matches have alternating open sides in one main face of the core and in the opposite face thereof. Moreover, the housings 4 which are all identical, are rectangular in cross-section and have short sides extending along the partition walls 3. Thus, in a cross-section perpendicular to the partition walls 3, the core has more or less a crenelated aspect.

The closure means is in the form of top bottom sheets 6, preferably of cardboard, which by means of an adhesive 8 is adhered to the non completely open longitudinal sides 7 of the housings 4, at both said mutually opposite main faces of the core 2, therefore in such a way that these sheets 6 will extend on the whole surface of these both faces and will form oblong compartments 12 which are closed along their longitudinal sides and wherein the matches are removably confined.

At the location of the end walls 3' of the core 2, the top sheet 6 has a flap 6' which is adhered to the outer side of this wall 3'. A similar flap 6' is provided on the top sheet, which covers the open side 5 of a terminal housing 4 of the core 2.

Further, the core has a wall 9 which closes the housings at their ends at the location of the space 10 where the head 11 of the matches 1 should be located.

The opposite end 13 of the housings 4 is open in such a way that the matches may project laterally from the core at this location.

A recess 14 is provided in the longitudinal side 7 of the housings 4 and extends from the wall 9 through the space 10 for the match head 11 in the direction of the end 13 of the housings, in such a way that this recess will cover about ⅔ of the surface of side 7. The remaining part 15 of thls longitudinal side 7 acts as a supporting surface for the match and is provided with two bevelled edges 16 and 17.

The bevelled edge 16 at the entrance of the housings 4 allows the mataches during their penetration into the housings to be guided along their supporting surface 15. The thickness of the side 7 at the location of the supporting surface is substantially equal to half of the difference between the thickness of the match head and of the match stick.

A striking strip 18 for the matches is provided at the side of the closure element 6 directed towards the housings 4. This striking strip is located near the end 13 of the housings.

Further, the closure element 6 has a raised part 19 in its side directed towards the housings 4, said raised part bearing elastically on the matches. In the embodiment of FIGS. 1 to 4, this raised part is a dent in the outer surface of the closure element 6 and it substantially corresponds to the thickness of side 7 at the location of the supporting surface 15.

In the embodiment of FIGS. 1 to 4, the striking strip 18 extends along the raised part 19.

The raised part 19 is located opposite to the supporting surface 15 but in such a way that the bevelled edge 17 is locatated closer to the wall 9.

Thus, two separate stages or movements can be distinguished during withdrawal of a match from a compartment 12 in the direction of arrow 20.

Figure 3:
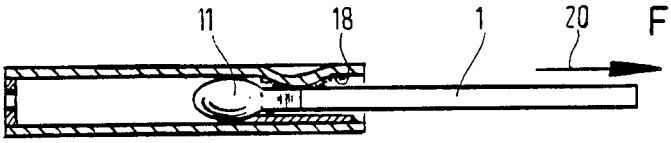
FIG. 3 is a section similar to FIG. 2 but wherein the match is in a first intermediate position.

In a first stage or movement, the match is moved substantially without frictional resistance until reaching the position shown in FIG. 3, that is until the moment that the head 11 reaches the bevelled edge 17. This bevelled edge is located such with regard to the striking strip 18 that the head 11 does not yet reach the latter in this position.

In a second stage or movement, the head 11 slides along the bevelled edge 17 and presses against the closure element 6 which faces it and which is somewhat deformed. Due to this fact, a relatively high resistance is created and a higher traction force should be applied to the match for withdrawing it further from its compartment. A consequence thereof is that the head 11, as soon as the resistance has been overcome, will rapidly slip through between the supporting surface 15 and the raised part 19 and that inflammation is produced only at the moment that the match has already left the compartment. Therefore, combustion can never take place at the interior of the compartment and any risk of inflammation of the package is excluded.

Figure 4:
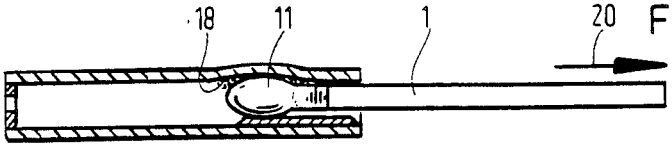
FIG. 4 is also a section similar to FIG. 2 but wherein the match is in a final intermediate position.

The indented part 19 has a double function: at one hand it ensures that the matches are always kept in the same position with regard to each other in the compartments 12, and at the other hand, the surface of contact between head 11 and striking strip 18 is increased, as can be seen clearly from FIG. 4.

Nevertheless, the part 19 is not absolutely necessary and may be omitted, if desired.

The matches are rectangular in cross-section and the longer side thereof extends parallel to the closure element 6 in such a way that the free ends of the matches, projecting from the core, will form a nearly continuous surface suitable for receiving publicity, if desired.

Moreover, the longer side of the rectangular cross-section of the matches is larger than the corresponding thickness of the head 11, in such a way that the latter cannot be clamped when pushed into the housings of the core.

The invented package is completed by a cover 21 which may comprise five successive panels 22, 23, 24, 25 and 26, in which case panel 22 is adhered to the outer side of one of the closure elements 6 and the other panels are capable of being folded around the core 2 in such a way that last panel 26 will contact the outer side of the first panel 22.

In order to close cover 21 around the core 2, a securing button 27 is provided. This button may be attached to the closure element 6 to which panel 22 is adhered, in such a way that this button will project through a corresponding hole 28 provided in said panel 22. Further, panel 26 has a hole 29 and the border of this hole will fit around button 27 when cover 21 has been closed around the core 2. Alternatively, the button 27 may be formed as part of the core 2, in which case, it projects through a suitable hole in the member 6 as well as through the panel 22 and also ultimately through the anchor hole 29 in the last panel 26.

If desired, panel 22 may be adhered directly to the core 2 and in that case it will be a closure element 6 as well. Panel 22 itself is provided then with a striking strip 18.

The embodiment shown in FIGS. 1–4 may have the advantage that cover 21 need not necessarily be arranged at the moment of packaging the matches in the core.

Thus, semi-finished packages including a core and matches arranged between two closure elements 6, might be laid up in store. Covers 21 provided with any publicity could then be applied later on according to demand.

Anyway, the matches are confined in the core 2 by means of the closure elements 6 and a product easy to handle is obtained.

Moreover, according to the invention, this matter can be used as a finished product which may be instance be removably placed onto a support, e.g., in a car, in combination with an ashtray, etc.

Figure 5:
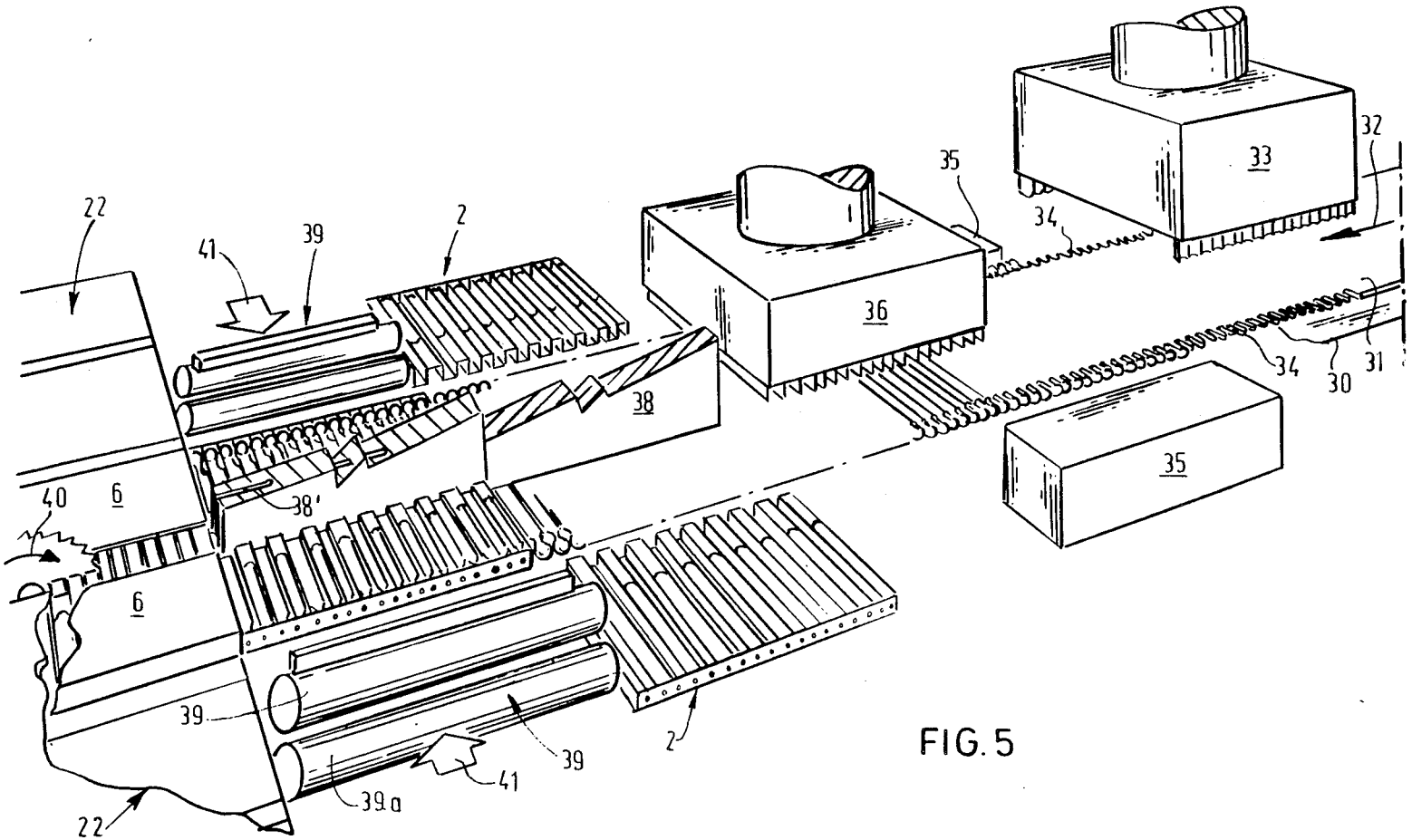
FIG. 5 is a schematic representation, in perspective view, of a special embodiment of the invented method and apparatus for the conditioning of matches.

FIG. 5 is a schematic representation of a special embodiment of the invented method and apparatus.

This apparatus comprises essentially a conveyor means, more particularly a platen 30, on which a thin sheet of wood 31 may be moved in its longitudinal direction indicated by arrow 32; cutting means 33 for creating teeth 34 in both longitudinal edges of the sheet 31; baths and means 35 (known per se) for treating the wood and for impregnating the wood and the teeth with such baths; dividing means 36, preferably chopping means, for dividing the sheet 31 into narrow parallel sticks 37 in such a way that a tooth is present at each end of such sticks; clamping means 38 for retaining the sticks in relation to each other; pasting means 39 for applying an adhesive 8 to the outer sides of the cores; supply means (not shown) for pushing cores 2 onto both ends of the sticks 37 in such a way that a stick will penetrate into each of the housings of these cores; covering means (not shown) for adhering the closure elements 6 and if desired, the cover 22 to the outer side of the core; and finally sawing means 40 permitting the sticks 37 to be sawed in the middle to form matches 1 of suitable length.

During the sawing step, the sticks 37 are preferably retained by the clamping means 38 and to this effect, the latter has a groove 38' into which the saw 40 may penetrate during progression of this clamping means.

If chopping means are used, it may be necessary to follow up the latter by distributing means (not shown) for bringing the sticks 37 at mutual distances which substantially correspond to the wall thickness of the partition walls 3 of the cores 2.

Preferably, the clamping means 38 may also function as a stop for the cores during movement of the letter along the sticks in the direction of arrows 41. Thus, care is taken that the matches will always have the same relative position within the cores.

The pasting means 39 may, e.g. comprise two rollers **39*a* and 39*b*** mounted one above the other (one being driven) and capable of engaging an empty core between them.

The cylindrical surfaces of these rollers are continuously coated with adhesive. Thus, the pasting means permit, apart from applying adhesive 8 to the cores, to move the latter at the same time in the direction of arrows 41 towards the clamping means.

The thickness of the sheet of wood 31 corresponds to the smallest thickness of the matches. This sheet may be continuous or may be composed of separate pieces having e.g., a length equal to a multiple of the length of a core. In the latter case, the conveyor means may, e.g., be a conveyor belt which moves in a discontinuous way in the direction of arrow 32.

In the supply means, the cores may either be moved separately onto the sticks at either side of the conveyor means, as shown schematically in FIG. 3, or by groups of five or ten or more cores which are closed up along the conveyor means and which are moved together onto a corresponding number of stickes. The striking strip 18 might as an alaternative be present at the outer side of the package.

Forming the raised part 19 at the inner side of the closure element 6 is preferably effected after adhereing this closure element to the core 2.

This raised part permits, inter alia, retention of the matches within the compartments 12 at the same relative position with regard to each other.

The striking strip 18 is preferably continuous at the inner side of the closure element 6.

If desired, use may be made of a sheet of wood 31 having a width substantially corresponding to the length of one single match. In that case, only one of the longitudinal edges is provided with teeth 34 and the supply means for moving the cores onto the sticks, is present along one side of the sheet.

The baths and means 35 for treating the wood and for applying an inflammable substance to the teeth 34 may consist of those which are now used in the traditional methods of manufacturing matches. Thus, this treatment may include the following steps: immersing the sheet or the chopped sticks into a phosphate bath to prevent pulverization of the ashes, immersing them into paraffin to permit a regular progression of the flame, drying the immersed sheet or sticks, etc.

Finally, from a publicity point of view, it is possible to provide holes 41 in the oblong compartments 12, e.g., through the wall 9 of the core 2, so that a certain noise through these holes is produced when an air flow is applied from the opposite open end of these compartments, and so that the empty package may be used as a mouth organ, if desired.

Preferably, this is only used in packages where the striking strip 18 is at the outside of the compartment 12 and where it may be removed in a simple way, if desired, if all matches have been used. This striking strip may preferably cover said holes.

As shown in the specification, the method of manufacturing matches and the step of inserting them into the invented package may be effected in a continuous way. Moreover, any waste of wood is restricted to a strict minimum.

Of course, the invention is not limited to the embodiments described above of the method and apparatus for separately conditioning matches, and many variants may be considered within the framework of the invention, e.g., with relation to the different devices used. Moreover, the shape of the cores may be subject to many modifications. Thus, inter alia, the recess 14 might be rectangular and might be restricted to the space 10 for the head of the match, thus creating a longer support surface 15. Further, if desired, use might be made of wood of inferior quality or of wood types that have less waste, or of another material such as a synthetic resin, for manufacturing the matches, since these matches are only subjected to a simple traction force along their longitudinal axis during the striking step. Therefore, the matches may be less strong than those matches which are to be rubbed along the striking strip under a certain angle.

What is claimed is:

1. A match package comprising the combination of:

a core presenting opposite side walls having generally parallel end edges, said core including a plurality of generally parallel, spaced partition walls connecting the opposite side walls and extending from one end edge to the opposite end edge of the side walls, one of the side walls having long oblong openings extending from adjacent one end edge thereof through the opposite end edge thereof between every other pair of adjacent partition walls and short oblong openings extending from adjacent the one end edge toward but terminating short of the opposite end edge between the remaining adjacent pairs of partition walls, the other side wall likewise having long oblong openings extending from adjacent the one end edge thereof through the opposite end edge thereof between every other pair of adjacent partition walls and short oblong openings extending from adjacent the one end edge toward but terminating short of the opposite end edge between the remaining adjacent pairs of partition walls, the long and short openings of the respective side walls being opposed to each other and in overlapping relation;

closure means secured to the opposite side walls of the core in covering relation to said openings for defining a series of match-receiving compartments within the core which are of uniform height within the overlapping regions of the openings, of reduced height in regions at the open ends of the compartments between opposed areas of the side walls, closed at said one end edge and open at the opposite end edge;

a plurality of matches each having a head end received in a respective compartment adjacent the closed end thereof and a free end projecting from the open end of its compartment, the head end of each match being of a thickness substantially the same as said substantially uniform height; and striking means in each compartment within the region thereof of reduced height for frictionally engaging a match head automatically to strike same in response to axial withdrawal of the match from the compartment.

2. A match package as defined in claim 1 wherein said striking means is provided on said closure means.

3. A match package as defined in claim 1 wherein said closure means is provided by a top member and a bottom member and said striking means is provided both on said top member and said bottom member on alternately opposite sides of the compartments.

4. A match package as defined in claim 1 wherein said core is integrally formed of plastic material.

5. A match package as defined in claim 1 including a cover having a series of panels one of which is adhered to one face of the closure means and the remainder of which removably envelopes said package.

6. A match package as defined in claim 5 including a securing button for holding said cover in enveloping relation to said package.

7. A match package comprising the combination of:

a generally flat core having opposite side surfaces and closure means secured to the opposite side surfaces of said core for defining a match-receiving spaced therewith, said core including a series of partition walls disposed in generally parallel relation and cooperating with said closure means to divide said match-receiving space into a plurality of adjacent oblong compartments, first means joining said partition walls at one end of the compartments for reducing the height of each compartment for a portion only of the length thereof while leaving said one end of each compartment open as well as the side of each compartment beyond such first means open and of substantially uniform height greater than the reduced height provided by the first means, and second means joining said partition walls at the opposite ends of the compartments for blocking said opposite end of each compartment;

a plurality of matches each having a head end received in a respective compartment adjacent said opposite end thereof and a free end projecting from said one end of its compartment, the head end of each match being of a thickness substantially the same as said substantially uniform height; and striking means in each compartment within said portion thereof of reduced height for frictionally engaging a match head automatically to strike same in response to axial withdrawal of the match from the compartment.

8. A match package as defined in claim 7 wherein said first means are respectively on the top and the bottom of the package at adjacent compartments.

9. A match package as defined in claim 8 wherein said core is formed of synthetic resinous material.

10. A match package comprising the combination of:

a generally flat core and closure means secured to said core for defining a match-receiving space therewith, said core being formed of synthetic resinous material and integrally including a series of partition walls disposed in generally parallel relation and cooperating with said closure means to divide said match-receiving space into a plurality of adjacent oblong compartments, first means joining said partition walls at one end of the compartments for reducing the height of each compartment for a portion only of the length thereof while leaving said one end of each compartment open as well as the side of each compartment beyond such first means open and of substantially uniform height greater than the reduced height provided by the first means, and second means joining said partition walls at the opposite ends of the compartments for blocking said opposite end of each compartment;

a plurality of matches each having a head end received in a respective compartment adjacent said opposite end thereof and a free end projecting from said one end of its compartment, the head end of each match being of a thickness substantially the same as said substantially uniform height; and striking means carried by said closure means and projecting into each compartment opposite said first means for frictionally engaging a match head automatically to strike same in response to axial withdrawal of the match from the compartment.

11. A match package as defined in claim 10 wherein said closure means is inwardly deformed locally opposite said first means.

* * * * *